US005095413A

United States Patent [19]

Goldberg

[11] Patent Number: 5,095,413

[45] Date of Patent: Mar. 10, 1992

[54] ELECTRIC LAMP ASSEMBLY AND METHOD

[76] Inventor: Gerald M. Goldberg, 10308 Laramie Ave., Chatsworth, Calif. 91311

[21] Appl. No.: 614,018

[22] Filed: Nov. 9, 1990

Related U.S. Application Data

[63] Continuation of Ser. No. 247,768, Sep. 22, 1988, abandoned.

[51] Int. Cl.[5] ..... F21V 21/00

[52] U.S. Cl. ..... 362/238; 362/240; 362/244; 439/393

[58] Field of Search ..... 362/219, 223, 226, 238, 362/240, 249, 448; 439/393

[56] References Cited

U.S. PATENT DOCUMENTS

| | | | |
|---|---|---|---|
| 2,692,375 | 10/1954 | Carson . | |
| 2,920,184 | 1/1960 | Kessler | 362/320 |
| 3,079,458 | 2/1963 | Hedstrom | 174/117 |
| 3,249,908 | 5/1966 | Fuller et al. | 439/393 |
| 3,444,607 | 5/1969 | Peterson et al. | 439/393 X |
| 3,527,933 | 9/1970 | Thommel | 362/226 |
| 3,861,772 | 1/1975 | Shaffer | 439/393 |
| 3,894,225 | 7/1975 | Chao | 362/219 |
| 3,898,422 | 8/1975 | Fuller et al. | 219/201 |
| 4,045,665 | 8/1977 | Williams et al. | 362/223 |
| 4,092,562 | 5/1978 | Campbell | 439/393 |
| 4,158,221 | 6/1979 | Agabekov | 362/219 |
| 4,204,273 | 5/1989 | Goldberg | 362/240 |
| 4,363,082 | 12/1982 | Roland | 362/219 |
| 4,482,944 | 11/1984 | Roossine et al. | 362/806 |
| 4,490,777 | 12/1984 | Tanner et al. | 362/223 |
| 4,514,791 | 8/1985 | Tokieda | 362/448 |
| 4,521,838 | 6/1985 | Agabekov | 362/214 |
| 4,521,839 | 6/1985 | Cook et al. | 362/240 X |
| 4,569,568 | 2/1986 | Agabekov | 439/393 |
| 4,654,765 | 3/1987 | Laidman | 362/238 |
| 4,667,276 | 5/1987 | Cheng | 362/249 |
| 4,855,882 | 8/1989 | Boss | 362/219 |
| 4,908,743 | 3/1990 | Miller | 362/238 |

*Primary Examiner*—Ira S. Lazarus
*Assistant Examiner*—Y. Quach
*Attorney, Agent, or Firm*—Poms, Smith, Lande & Rose

[57] ABSTRACT

An electrical assembly of low voltage lamps is disclosed wherein the individual low voltage lamps have rigid lamp leads removably insertable into individual ones of a plurality of electrically conductive socket members which are retained in electrical contact with a pair of electrical wires by virtue of the resiliency of the surrounding insulating covering. The socket members are assembled in pairs to the flexible electrical core by being inserted into the cord cover and into engagement with the electrical wires contained therein by forming a portion of the electrical cord into a curve and penetrating the covering in a marginal area of such curved portion so that the straight configured socket leads penetrate the covering in substantial parallel relationship to adjacent wire portions which are linear. An apparatus for driving a pair of socket members concurrently into engagement with the electrical wires within an insulated covering is disclosed as are exemplary forms of transparent plastic material enclosures for enclosing the assembly of low voltage lamps and flexible electrical cord.

14 Claims, 4 Drawing Sheets

Fig. 4.
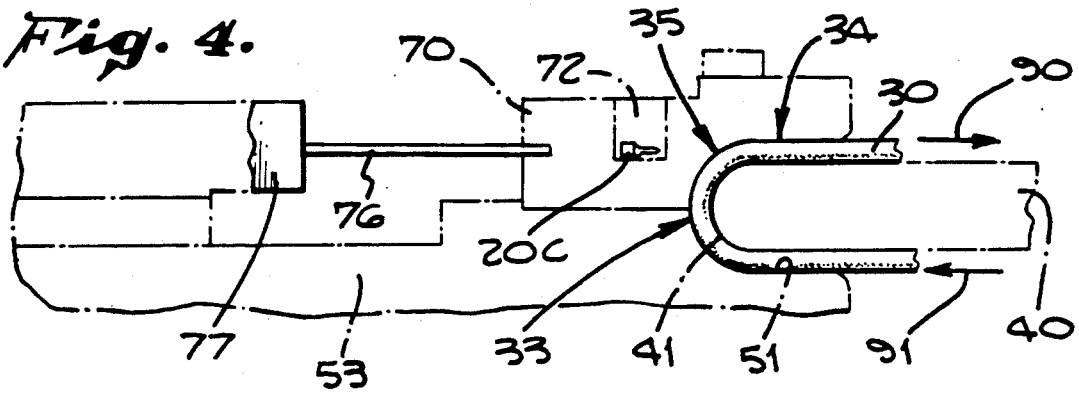
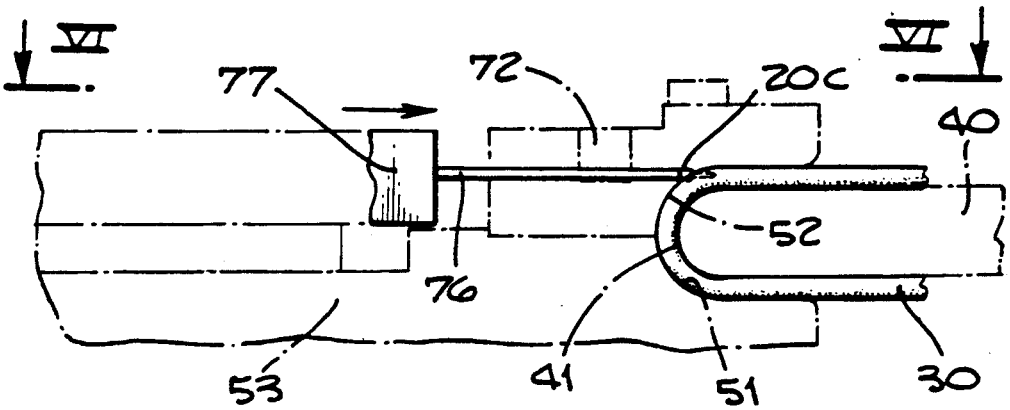
Fig. 5.
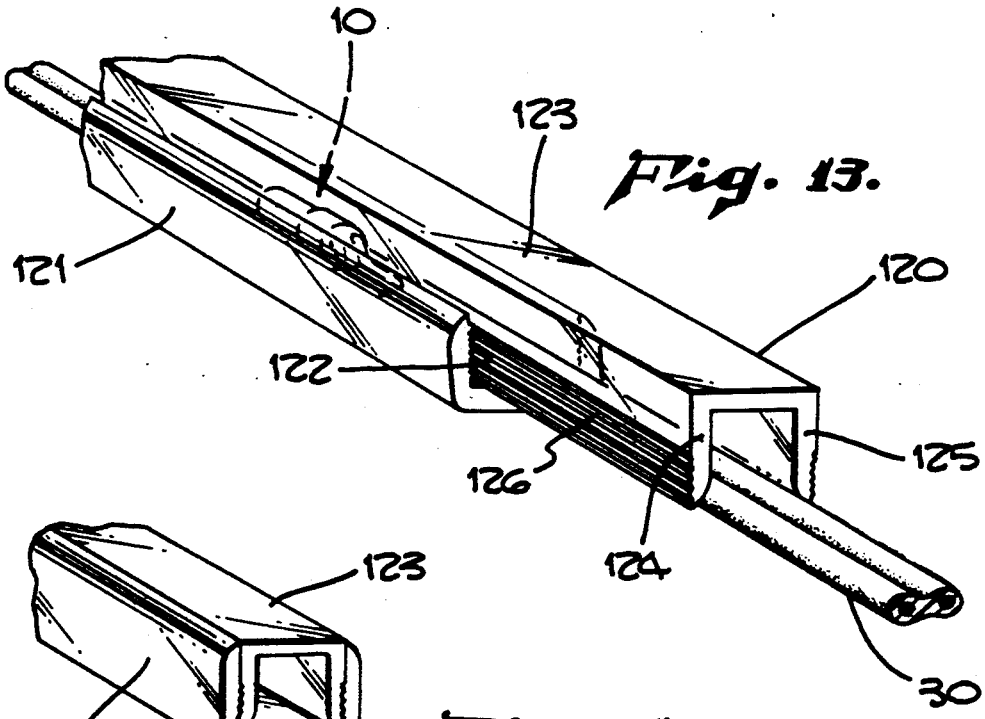
Fig. 13.
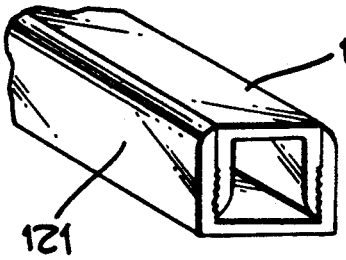
Fig. 14.

ELECTRIC LAMP ASSEMBLY AND METHOD

This is a continuation of copending application Ser. No. 07/247,768 filed on Sept. 22, 1988 now abandoned.

BACKGROUND OF THE INVENTION

Generally stated, the present invention relates to ribbon like low voltage electrical lamp assemblies wherein a plurality of low voltage lamps are mounted in electrical communication with electrical conductors or wires contained within a flexible electrical cord, ribbon or the like and more specifically to a method and apparatus for fabricating such electrical assemblies wherein the lamps are easily replaced when they become defective.

Low voltage electrical lighting has received increased acceptance in the lighting industry for both decorative and functional lighting installations. Exemplary thereof is the construction of illuminating ribbon of light bulbs of my prior U.S. Pat. No. 4,204,273 in which a flexible conductor of strip configuration is disclaimed. A pair of copper conductors are laminated between a pair of installing material layers, one of the layers comprising vinyl and having an elastic deformation characteristic, such that the lamp wire leads are held directly against the copper conductors by the memory of the insulating cover of the conductors. In accordance with my prior patent disclosure, the insulating material of the flexible conductor is upset manually through the use of a pointed tool and the thin wire leads of the lamp are simply slid into electrical contact with the copper conductors and held in place by the resiliency of the insulation material cover which tends to return to its original position.

While it is common to replace the lamps in the construction of my prior patent when necessary by simply removing an old bulb, reestablishing the tunnel for each lead in the conductor and assembling a new lamp, I have found that it would be desirable to be able to employ a low voltage lamp having lamp leads which are of a more heavy gauge and more rigid nature, particularly where the rigidity or bendability of the wire leads of the lamp are to be employed in orienting the lamp in a desired angular relationship relative the conductor to which they are assembled. In addition, I have found that an improved method of assembly and relamping of a previously constructed assembly would be desirable for use with thicker insulation type conductors which, while having a resilient plastic covering, may not employ the vinyl covering as in the embodiment of my prior patent. Specifically, lamp cord employed in many low voltage lamp assemblies has a fairly thick insulation of plastic material and is suitable for a more heavy duty type lamp lead assembly and reassembly technique than in the case of the ribbon like conductors disclosed in my prior patent.

SUMMARY OF THE INVENTION

In view of the foregoing, it is the primary object of the present invention to disclose and provide an improved low voltage lamp and electrical conductor assembly wherein the assembly, reassembly or relamping of the low voltage lamps is facilitated and an increased durability as well as an increased versatility in the nature and form of electrical conduit is afforded. It is a further object of the present invention to disclose and provide a method of assembling such electrical assemblies as aforestated as well as an exemplary apparatus for accomplishing the same in a semi-automated manner.

Generally stated, the improved low voltage electrical assembly of low voltage lamps and flexible electrical conduit of the present invention comprises the provision of a low voltage lamp having bendable, though reasonably rigid, electrical leads together with the provision of individual electrically conductive socket members which are embedded in the electrically conductive cord, ribbon or the like beneath the associated insulating cover in electrical contact with the wire strands, copper strips or other conductors within such coverings. The socket members are retained in such electrical engagement with the electrical wires or conductors within the surrounding insulation by the resiliency of such insulation and the configuration of the socket members.

The socket members are preferably provided with a cylindrical body having a tunnel like configuration through the provision of a lamp wire receiving bore within the body. A socket lead of smaller rod like diameter having a pointed end extends from a forward end of the socket member to facilitate penetration of the electrical conductor insulation covering as well as a wedging like fit between the insulation covering and the electrical conductor contained therein. Preferably, a pair of such socket members are concurrently inserted under the insulation covering into electrical contact with spaced pairs of electrical conductors, as copper wire or strips therein, to provide a pair of such sockets for each low voltage lamp which typically has a pair of lamp leads to be assembled thereto.

Such assembly of the sockets to the electrical conductors is facilitated by forming the electrical conductor, in accordance with the present method, into adjacent curved and straight portions and holding the portions stationary, positioning the socket members to be aligned thereto with the socket leads having their pointed ends facing marginal areas of the curved portions and adjacent the straight portions so that the leads may penetrate the insulation covering in a substantially parallel motion to the extent of the electrical wires or ribbons contained within the insulation and be wedged between such insulation and the electrical conductors in such straight portions, the penetration through the insulation occurring in the adjacent curved portion.

An exemplary apparatus for accomplishing the method of the present invention includes an anvil for positioning the electrical conductor in a desired curved configuration and a clamp for holding it in such curved position. Guide bores are provided in a guide block associated with the clamp as are socket member feed means so that the socket members may be automatically positioned to the guide bores for being injected into the clamped electrical conduit. Pneumatic means are provided for selectively driving a pair of drive rods through the guide bores to drive the socket members positioned in such bores into the electrical conduit as discussed hereinbefore. The clamp is moveable mounted relative the anvil and the pneumatic means for driving the drive rods, as well as the drive mounting drive block, are movably mounted relative the clamp so as to initially provide a clamping action to hold the electrical conduit stationary and then to drive a pair of socket members in the desired manner aforedescribed into a wedging penetrating relation beneath the electrical conductor insulation and in contact with the electrical wires or ribbons contained within the covering.

A more complete understanding of the electrical assembly, method of assembly as well as the exemplary apparatus for accomplishing the same, in accordance with the present invention, will be afforded to those skilled in the art, and well as a better understanding of additional objects and advantages thereof will be attained, by a consideration of the following detailed description of a preferred exemplary embodiment thereof. Reference will be made to the appended sheets of drawings which will be first described briefly.

BRIEF DESCRIPTION OF THE DRAWINGS

FIG. 4 is a detail view of a portion of the apparatus of FIG. 3 showing a clamping portion of the apparatus closed upon an exemplary flexible electrical cord holding it in a curved configuration.

FIG. 5 is a view as in FIG. 4 showing the apparatus inserting a pair of electrically conductive socket members concurrently into electrical contact with the exemplary electrical conductor.

FIG. 13 is a perspective view of portions of an alternative exemplary embodiment of transparent plastic enclosure for use with the flexible electrical cord and low voltage lamp assembly of the present invention.

FIG. 14 is a end perspective view of the enclosure of FIG. 13.

DETAILED DESCRIPTION OF THE PREFERRED EXEMPLARY EMBODIMENT

Figure 1:
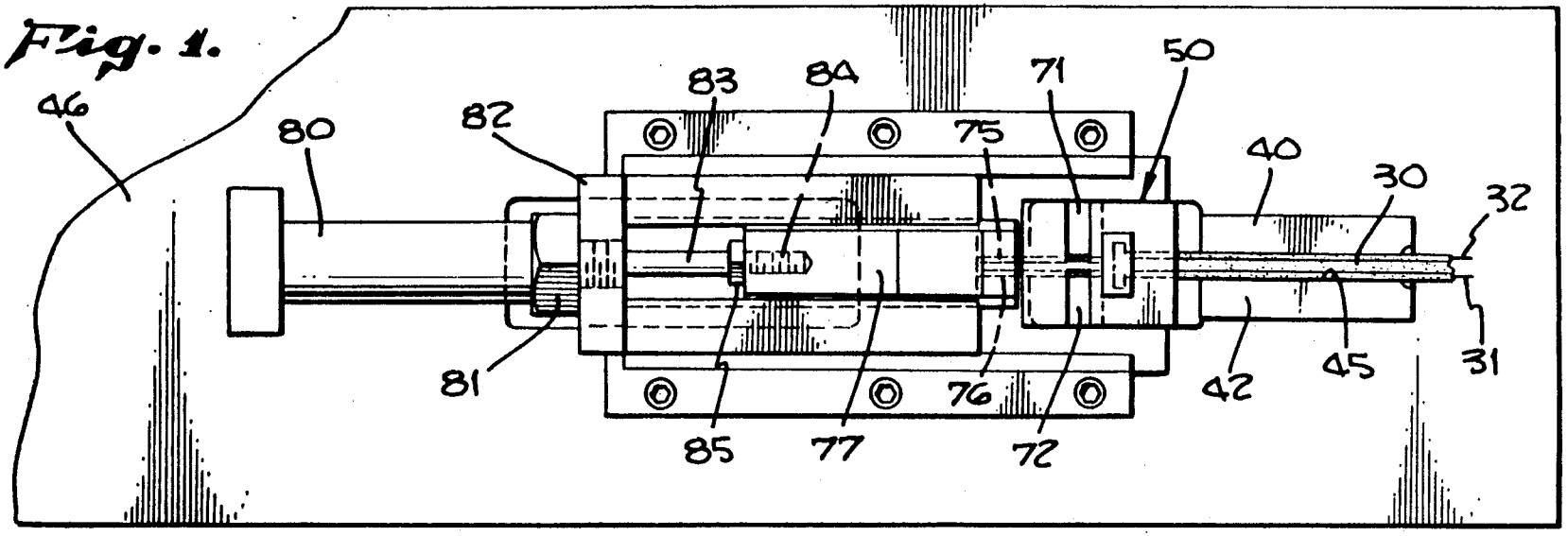
FIG. 1 is a plan view of apparatus employed in the present method of assembling low voltage lamps to a flexible electrical conductor.

The structure and method of assembling of a low voltage lamp and flexible electrical conductor assembly, in accordance with the present invention, will now be explained in detail with reference to the appended drawings, like reference numerals in different figures referring to the same elements. The electrical conductor employed with the electrical assembly, and present method of assembling the same, may comprise a flat ribbon conductor as disclosed in my prior U.S. Pat. No. 4,204,273, a standard twin wire conductor generally known in the industry as "lamp cord" or "SPT-1" or similar types of twin electrical wire or conductive strips which are enclosed within an electrically insulating cover made of a material which has sufficient resiliency or memory so that it will tend to hold a socket inserted beneath the cover in electrical contact with the electrically conductive strip or wire in the manner the lamp leads are retained to the ribbon conductor of my prior U.S. Pat. No. 4,204,273. In that patent, the flexible lamp leads are directly inserted under the vinyl insulation cover into contact with the inner electrical wires or ribbons and held in place by the resiliency or memory of the vinyl cover which tends to return to its original undeformed state. Moreover, the present method of electrical assembly is also suitable for use with the thicker insulation found on "lamp cord".

Figure 8:
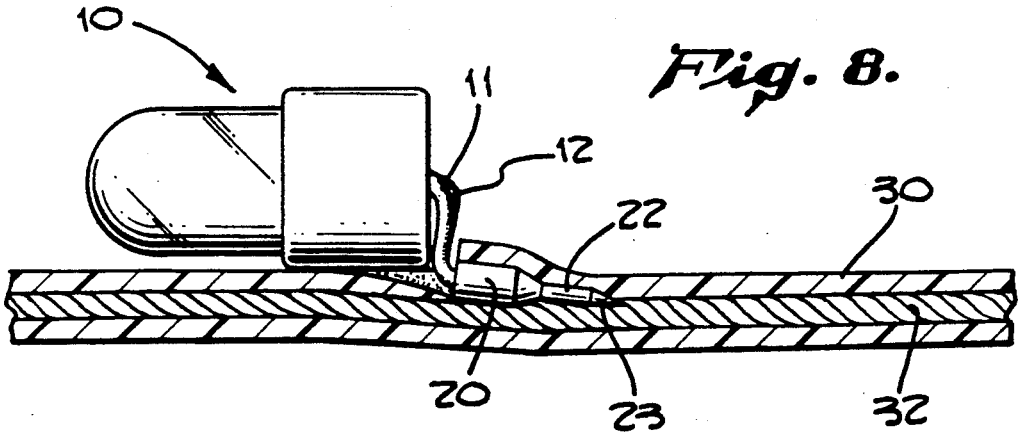
FIG. 8 is a view as in FIG. 7 showing the electrical attachment of a low voltage electrical lamp.

In accordance with the present method, the low voltage lamps, as indicated generally at 10 in FIG. 8 are preferably provided with relatively heavy gauge rigid, although bendable, leads 11 and 12 as are available in the industry. Such lamps, having such heavier gauge lamp leads, are more suitable for relamping of an electrical cord or ribbon assembly in the environment of the structure and method of the present invention than are the finer gauge lamp leads employed in the disclosure of my prior patent.

Figure 6:
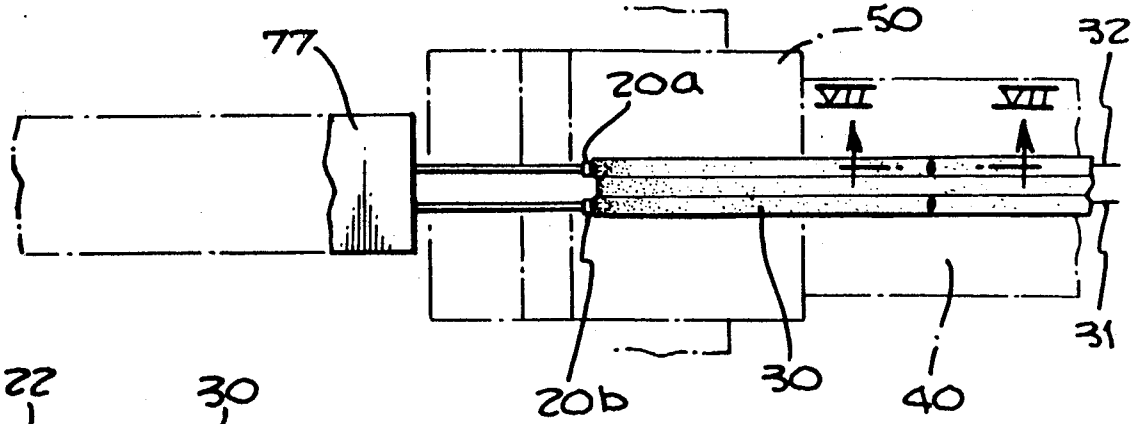
FIG. 6 is a plan view of the portion of the apparatus of FIG. 5 taken therein along the plane VI—VI.
Figure 7:
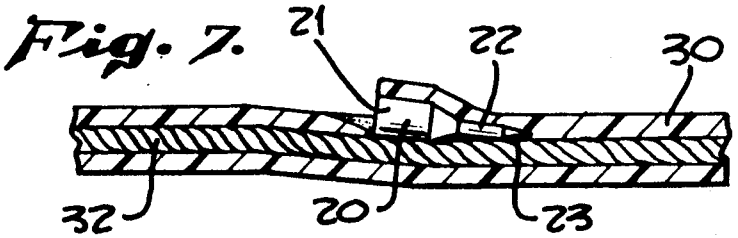
FIG. 7 is a detail view showing an exemplary embodiment of electrically conductive socket member inserted under the insulation cover of an electrical cord, or the like, with the socket and its associated lead in electrical conduct with the stranded wire enclosed in the insulation cover of the electrical conductor of FIG. 6 taken therein along the plane VII—VII.

As is particularly contemplated within the present invention, electrically conductive socket members, as socket member 20, as seen in FIGS. 7 and 8, are provided for replaceable assembly of the low voltage lamps, as the lamp indicated generally at 10 in FIG. 8, relative the exemplary lamp cord 30 as seen in FIGS. 7 and 8. The exemplary lamp cord 30 comprises a pair of electrically conductive stranded wires 31 and 32, said wires being seen in FIGS. 1 and 6, only wire 32 being seen in the side, partially sectioned, views of FIGS. 7 and 8. Each of the sockets 20 are provided with a tunnel like body 21 which has a hollow bore for receiving a slip friction fit of the rigid lamp leads 11 or 12. To facilitate insertion of the sockets, as socket 20 in FIG. 7, into the electrical conductor, as cord 30 in FIG. 7, each of the sockets in accordance with the present invention is provided with a socket lead 22 which has a pointed end 23. Preferably, the sockets and lamp leads are gold-plated to provide for a maximum electrical conductivity therefor.

In accordance with the present method, the electrically conducted socket members, as socket member 20 in FIGS. 7 and 8, are inserted in pairs, concurrently with one another, into electrical contact with the electrical wires or conductors within the associated insulation covering by forming the electrical cord, or the like, into adjacent curved and straight portions, holding such portions stationary and then aligning and inserting the socket members through marginal areas of the curved portion into parallel metal to metal engagement with the electrical wire or conductor within the insulation covering as will now be described in association with the apparatus illustrated in FIGS. 1 through 6, the latter being exemplary of how the method of the present invention can be accomplished.

Figure 2:
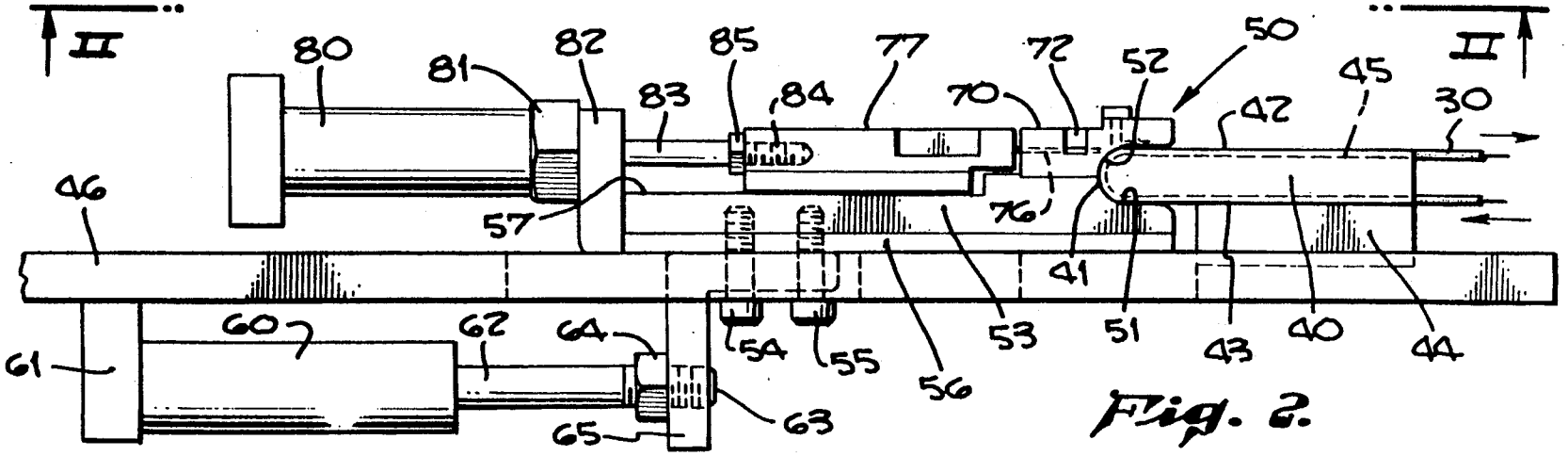
FIG. 2 is a side elevational view of the apparatus of FIG. 1 taken therein along the plane II—II.
Figure 3:
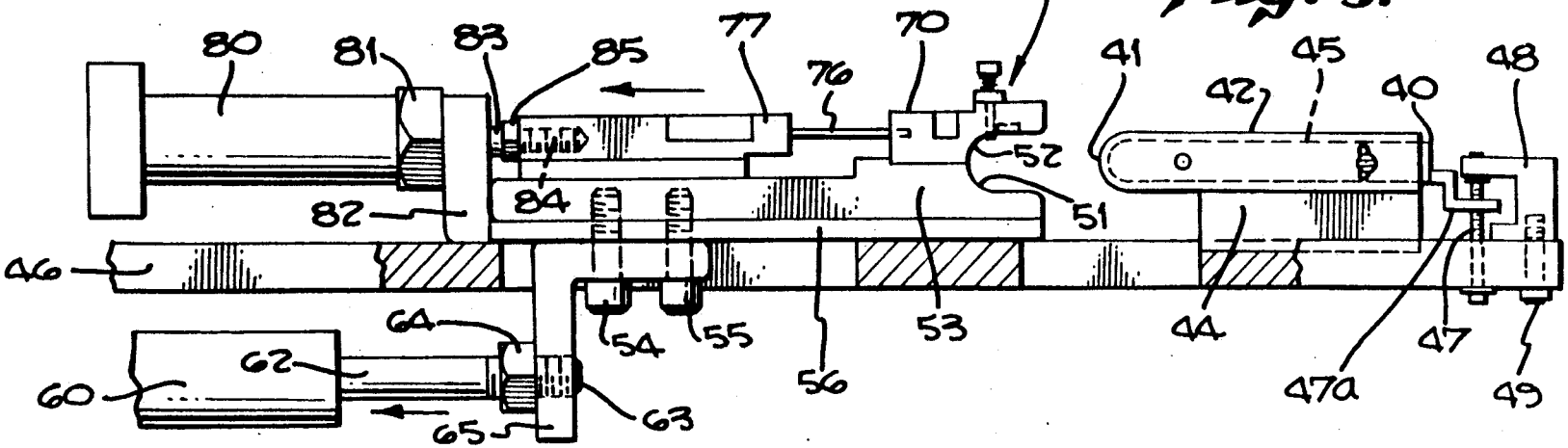
FIG. 3 is a view as in FIG. 2 showing the apparatus in an open position.

As seen in FIGS. 1, 2 and 3, anvil 40 is mounted in a fixed, stationary position a suitable support plate or table 46. The anvil 40 is provided with a semi-circular working end 41 and flat upper and lower surfaces 42 and 43 extending laterally of a side flange 44. Anvil surfaces 41, 42 and 43 are thus provided so that an electrical conductor, as lamp cord 30, can be run around the anvil. The feeding of such cord can be done manually or automatically by an appropriate means for running the cord about the anvil. As in the exemplary embodiment, anvil 40 preferably has a guide groove 45 which is formed in the anvil surfaces 41, 42 and 43 to guide the cord 30 thereabout. Preferably, a depth of such guide groove is such as to provide for upper portions of cord 30 to be exposed above surfaces 41, 42 and 43 so as to be engaged by the associated clamp as subsequently described. The inclination of anvil 40 relative its supporting side flange 44 may be adjusted via the tailpiece 47A being threadably connected to turn screw 47 which in turn is mounted between block 48 and table 46. Block 48 is fixed to table 46 by bolts, as bolt 49. Rotation of turn screw 47 thus adjusts the elevation of the rear end of anvil 40, that being a pin and vertical slot connection between the anvil plate 44 as seen in FIG. 3.

In order to hold the electrical conductor, cord 30 in the exemplary embodiment, in a stationary position during insertion of the electrically conductive socket members, as socket members 20 in FIGS. 7 and 8, a clamp, indicated generally at 50, is provided including clamping surfaces 51 and 52 for engaging the electrical conductor run about anvil 40. As seen in FIGS. 2 and 3, the clamp surface 51 is formed in clamp body 53 which is affixed by bolts 54, 55 to clamp slide 56. Slide 56 is moveable toward and away from the anvil by means of the pneumatic cylinder 60 which is mounted by it mounting flange 61 to plate 46 and includes a piston associated rod 62 connected by its threaded end 63 and nut 64 to the right angle flange 65, the latter being secured by bolts 54 and 55 to the underside of slide 56. Operation of pneumatic cylinder 60 in a manner known in the art and thus move the clamp body 53 and its associated clamp surface 51 into and out of engagement with the working end 41 of anvil 40, and in the electrical conductor curved thereabout.

As is also seen in FIGS. 2 and 3, the upper clamp surface 52 is formed as part of a socket loading station and guide block 70. Guide ramps 71 and 72 are provided for guiding individual ones of the circular socket members into alignment grooves aligned with guide bores 73 and 74 provided within block 70 as seen in FIGS. 1, 4 and 5. The pair of spaced drive rods 75 and 76 which never fully withdraw from bores 73 and 74 are selectively driven to push the pair of sockets, as sockets 20*a* and 20*b* in FIG. 6, into the electrical conductor, as cord 30. The socket leads 22 and bodies 21 are thereby driven under the insulation cover and into electrical contact with the associate electrical wires or conductors, as wire 32 as seen in FIG. 7. Push rods 75 and 76, are mounted to a socket driver block 77 which, as seen in FIGS. 2 and 3, is slidably moveable upon clamp body 53 relative the stationary block 70 via the provision of pneumatic cylinder 80 which is mounted by an appropriate threaded end and mounting nut 81 to flange 82 formed integrally of the slide 56. Pneumatic cylinder 80 is provided with a piston rod 83 which is secured by its threaded end 84 and mounting nut 85 to the rear end of block 77, the latter simply sliding upon the upper surface 57 of clamp body 53 between its retracted position of FIG. 3 and its socket insertion position of FIG. 2.

As shown somewhat schematically in FIGS. 4 and 5, when the electrical conduit, as cord 30, has been moved into a desired curved configuration about anvil 40, it is clamped by the clamp surfaces 51 and 52 coming into engagement therewith, through the shifting of clamp body 43 under the urging of cylinder 60 to the right in FIGS. 4 and 5. Cord 30 is thereby held in a curved configuration wherein it has a first semi-circular configuration portion, indicated generally at 33, and an adjacent linear or straight portion, indicated generally at 34, with the socket member 20*c* and its associated pointed lead being substantially parallel to the extent of the electrical conductor wire within the straight portion of cord 30. With the socket member 20*c* on oriented and the cord 30 held by the associated clamp surfaces 51 and 52 to anvil working end 41, the pneumatic cylinder 8 is actuated to drive the drive rods 75 and 76 through the guide bores 73 and 74 of guide block 70, as seen in FIG. 6, to drive the socket member 20*c* into cord 30 as seen in FIG. 5. Preferably, two such socket members 20*c* are driven into electrical engagement with the conductor wires 31 and 32, as shown in FIG. 6, respectively, of conduit 30 through the use of the apparatus disclosed, the representation of FIGS. 4 and 5 being a side view of the apparatus and thus showing only one of the two socket member assembly steps occurring as the drive block 77 is driven from the position of FIG. 4 to that of FIG. 5. Thereafter, the pneumatic cylinders 60 and 80 may be operated in the reverse direction to release the electrical conductor, as cord 30, with its assembled electrical socket members, so that the cord may be adjusted, as indicated by the arrows 90 and 91 in FIG. 4, to place the conductor in position for a next assembly operation of the associated socket members. It can thus be seen by those skilled in the art that a pair of socket members may be assembled to the electrical conductor in a rapid facile member by the method of the present invention to produce a continuing run of electrical conductor and assembled socket members for subsequent assembly of the low voltage lamps. Such assembly, as contemplated within the present invention is thereafter accomplished by mounting a low voltage lamp, as indicated generally at 10 in FIG. 8, by forming the lamp leads 11 and 12 of such a lamp into a desired relatively rigid configuration for simple insertion into the tunnel receptacles or bores of the individual sockets 20 as seen in FIG. 8. The lamps 10 can be laid upon their side as seen in FIG. 8, or, by the relative rigidity of the bendable leads 11 and 12, held in other positions relative the electrical conductor, as cord 30.

Figure 9:
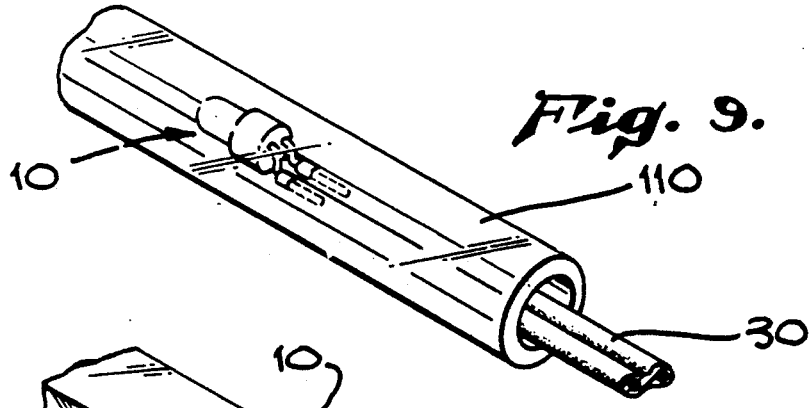
FIG. 9 is a perspective view of an exemplary embodiment of transparent tube of circular configuration having a low voltage lamp and flexible electrical cord assembly, in accordance with the present invention, provided therein.
Figure 10:
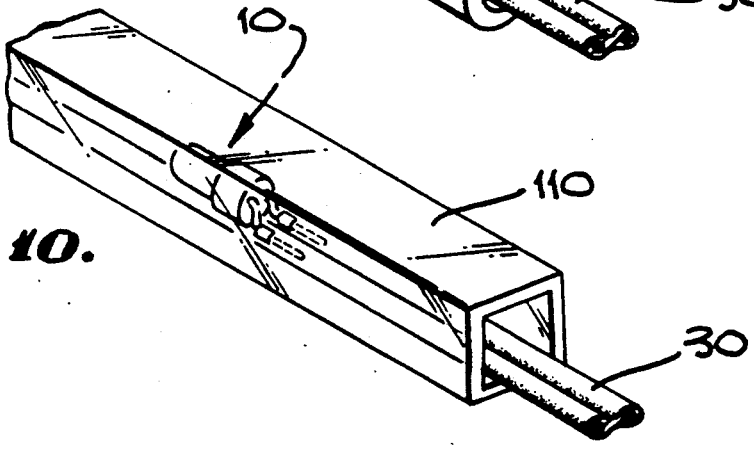
FIG. 10 is a view as in FIG. 9 showing a transparent tube of rectangular configuration surrounding the exemplary electrical assembly.
Figure 11:
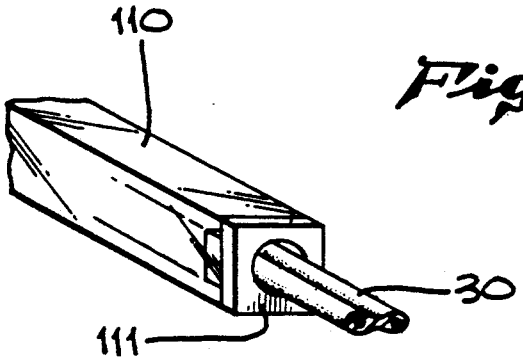
FIG. 11 is an end view of the assembly and tube of FIG. 10 showing an end cap having a cord receiving aperture.
Figure 12:
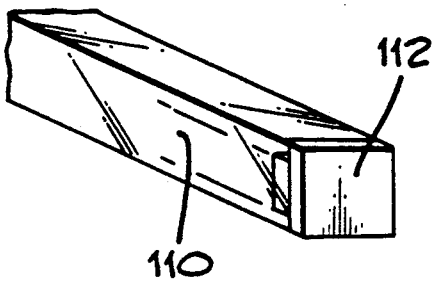
FIG. 12 is a view of an opposite end of the tube and electrical assembly of FIG. 10 showing an end cap closure.

With the low voltage lamps, as indicated generally at 10 in FIG. 8, laying upon their sides in assembled relation to the electrical conductor, as cord 30 in the exemplary embodiment, the electrical assembly thus provided may be fitted within a translucent or transparent housing such as indicated by the transparent plastic material circular tube 100 in FIG. 9 and the rectangular cross section tube 110 of FIG. 10. In both instances, end caps may be provided as illustrated by the apertured end cap 111 in FIG. 11 and the closed end cap 112 as seen in FIG. 12. Such transparent plastic tubes 100 and 110 may be formed of a polymeric material such an acrylic or polycarbonate plastic material. As a further alternative for an enclosure associated with the electrical assembly of cord 30 and low voltage lamps, as the lamp indicated generally at 10, a two part enclosure 120 may be provided which includes a base 121 which may be fabricated of extruded aluminum, plastic or even wood material in a channel configuration, the base 121 in the exemplary embodiment being provided by a transparent plastic channel having fine stratiations 122 on the order of 0.005 inches pitch, the material being preferably polycarbonate plastic. When using an aluminum channel, the imperfections on the inner surfaces of the aluminum extrusion side wall may be employed. In either event, the U-shaped cap 123 may be provided with side walls 124 and 125 which are somewhat resilient so as to be biased to spread laterally outwardly when pressed into the base 21. Stratiations 126 and 127 may be provided on such side walls 124 and 125 to facilitate the engagement of cap 123 with base 121, as seen in FIG. 14.

In the event that an individual lamp, as low voltage lamp 10 in the exemplary embodiment, becomes inoperative for any reason, the lamp may be simply removed from its associated friction fit with the socket members embedded under the covering of the electrical conductor and a new lamp replaced by slipping its leads into the associated socket members. When the electrical assembly is within an enclosure such as FIGS. 13 and 14, the cap 123 may be simply lifted off of the base 121 in the area where the defective lamp is found. Where the electrical assembly is within a tubular enclosure as tubes 100 and/or 110 in FIGS. 9 and 10, the assembly may be simply drawn out of the tube, the lamp replaced and the assembly drawn into the associated tube.

Having thus described a preferred exemplary embodiment of an electrical assembly of low voltage lamps with a pair of electrical conductors within an insulated cover in accordance with the apparatus and method of the present invention, it should now be apparent to those skilled in the art that the various objects and advantages aforestated for the present invention have been attained and that other embodiments, adaptations and modifications thereof may be made within the spirit and scope of the present invention which is defined by the following claims.

I claim:

1. A method of assembling a low voltage lamp to a flexible electrical cord having a pair of flexible electrical conductors lying within a surrounding resilient electrical insulation cover, said method comprising the steps of:

forming said electrical cord into a curved portion with an adjacent straight portion and holding said curved and straight portions stationary;

providing a pair of electrically conductive socket members, each having a rigid socket head with a pointed free end;

positioning said pair of socket members aligned to said cord with each socket lead having its pointed end facing a marginal area of said cord curved portion adjacent said cord straight portion in substantially parallel relation to the extent of said conductors in said cord straight portion;

driving said pair of socket members concurrently into assembled engagement with said cord by pushing said pointed end socket leads through said cover at said marginal area and in between said cover and conductor in said cord straight portion; and thereafter assembling a low voltage lamp having a pair of lamp leads to said cord by inserting said lamp leads into said socket members.

2. The method of claim 1 including the additional step of:

providing said lamp leads in the form of rigid pins whereby attachment and release of said lamp relative said socket members is facilitated.

3. The method of claim 1 including the additional step of:

providing a translucent tube having an inner diameter larger than the width of said cord and assembled low voltage lamp; and drawing said cord and low voltage lamp into said tube; and providing end caps on said tube, at least one of which has a cord aperture to accommodate passage of said cord therethrough.

4. A low voltage lamp and electrical conductor assembly comprising:

a pair of electrically conductive members individually electrically insulated within an electrical insulation cover of resilient material;

an electrically conductive socket member having a rigid socket lead mounted to each of said conductive members by said socket leads being trapped between said cover of resilient material and the associated one of said conductive members;

a single low voltage lamp having a pair of rigid wire lamp leads, each of said lamp leads being removably retained within one of said socket members whereby said lamp is removably assembled in electrical contact with said conductive members.

5. The low voltage lamp and electrical conductor assembly of claim 4 comprising:

an elongated transparent plastic material tube having open ends, said conductive members, cover and lamp lying within said tube; and removable end caps for closing said tube, at least one of said end covers having an aperture to facilitate running said cover and conductive members therethrough.

6. The low voltage lamp and electrical conductor assembly of claim 5 wherein:

said lamp is laid on its side against said cover within said tube.

7. The low voltage lamp and electrical conductor assembly of claim 4 wherein said assembly includes a plurality of low voltage lamps, each having a pair of rigid wire lamps leads removably retained within one of a plurality of sockets members in said electrically conductive members and an elongated transparent plastic material tube for enclosing said conductive members and lamps whereby said lamps are visible from all sides of said tube.

8. The low voltage lamp and electrical conductor assembly of claim 7 wherein said tube further comprises:

an upwardly opening channel shaped base of transparent plastic material having upstanding base sidewalls; and an inverted downwardly opening channel shaped top receivable in said base and having depending resilient walls which engage said base sidewalls by a friction fit of said resilient walls between said base sidewalls.

9. The low voltage lamp and electrical conductor assembly of claim 8 wherein said tube further comprises:

stratiations on portions of said resilient walls facing outwardly thereof to grip against said base sidewalls.

10. The method of claim 7 including the substep of providing said lamp with rigid wire leads.

11. A low voltage lamp and electrical conductor assembly comprising:

an elongated transparent plastic material tube providing visual perception of the interior thereof from all sides thereof;

a pair of electrically conductive members individually electrically insulated within an electrical insulation cover of resilient material extending within said tube; and a plurality of individual low voltage lamps removably assembled to said members whereby said lamps are visible through said tube from all sides thereof.

12. The low voltage lamp and electrical conductor assembly of claim 11 wherein said tube comprises:

an upwardly opening channel shaped base of transparent plastic material having upstanding base sidewalls; and an inverted downwardly opening channel shaped top receivable in said base and having depending resilient walls which engage said base sidewalls by a friction fit of said resilient walls between said base sidewalls.

13. The low voltage lamp and electrical conductor assembly of claim 12 wherein said tube comprises:

stratiations on portions of said resilient walls facing outwardly thereof to grip against said base sidewalls.

14. A method of assembling low voltage lamps, each of said lamps having a pair of bare wire leads in easily removable relation to a pair of electrical conductors run within a cover of electrically insulating resilient material comprising the steps of:

providing a plurality of electrically conductive socket members, each having a socket lead for engaging one of said conductors and a socket for removably receiving a wire lead of one of said low voltage lamps;

inserting the socket lead of at least two such socket members through said cover into electrical engagement with said conductors, whereby said two socket members are in generally laterally adjacent relation to and in electrical contact with said two conductors, respectively; and inserting the wire leads of a low voltage lamp into an adjacent pair of socket members to place said lamp into electrical contact with said conductors.

* * * * *